US006124086A

United States Patent [19]

Eikenberry et al.

[11] Patent Number: 6,124,086

[45] Date of Patent: Sep. 26, 2000

[54] LATENT IMAGE STABILITY USING ALKYNYLAMINES AND IODIDE EMULSIONS

[75] Inventors: Jon N. Eikenberry; Chris J. Johnson, both of Rochester, N.Y.

[73] Assignee: Eastman Kodak Company, Rochester, N.Y.

[21] Appl. No.: 09/232,963

[22] Filed: Jan. 19, 1999

Related U.S. Application Data

[63] Continuation-in-part of application No. 08/918,168, Aug. 25, 1997, abandoned.

[51] Int. Cl.[7] ..... G03C 1/34

[52] U.S. Cl. ..... 430/614; 430/613; 430/607; 430/551

[58] Field of Search ..... 430/607, 613, 430/614, 551

[56] References Cited

U.S. PATENT DOCUMENTS

| | | | |
|---|---|---|---|
| 4,374,196 | 2/1983 | Herz | 430/505 |
| 4,378,426 | 3/1983 | Lok et al. | 430/505 |
| 4,451,557 | 5/1984 | Lok et al. | 430/505 |
| 5,061,616 | 10/1991 | Piggin et al. | 430/569 |
| 5,164,292 | 11/1992 | Johnson et al. | 430/569 |
| 5,389,510 | 2/1995 | Preddy et al. | 430/567 |
| 5,399,479 | 3/1995 | Lok | 430/603 |
| 5,411,854 | 5/1995 | Brust et al. | 430/572 |
| 5,413,905 | 5/1995 | Lok et al. | 430/600 |
| 5,491,056 | 2/1996 | Wen et al. | 430/569 |
| 5,500,333 | 3/1996 | Eikenberry et al. | 430/567 |
| 5,576,170 | 11/1996 | Eikenberry et al. | 430/567 |
| 5,763,146 | 6/1998 | Reynolds et al. | 430/377 |
| 5,773,208 | 6/1998 | Hall et al. | 430/607 |

FOREIGN PATENT DOCUMENTS

| | | | |
|---|---|---|---|
| 0 845 705 A1 | 6/1998 | European Pat. Off. | G03C 7/392 |

*Primary Examiner*—Mark F. Huff
*Attorney, Agent, or Firm*—Paula A. Leipold

[57] ABSTRACT

The invention relates to a photographic element wherein at least one layer comprises silver halide grains wherein said grains have a surface iodide of less than 0.6 mol percent, total grain iodide of about 1.0 to 10 mol percent, said iodide being introduced in the core of the grains, an alkynylamine compound of Formula I:

I wherein X represents oxygen, sulfur, selenium, or an unsubstituted or alkyl substituted nitrogen; $R^1$ represents hydrogen or an alkyl of from 1 to 5 carbon atoms, and $R^2$ represents hydrogen, or an alkyl, aryl, heteroaryl, carbocyclic or heterocyclic group, and $R^3$ and $R^4$ independently represent hydrogen, halogen, or a substituted or unsubstituted alkyl or alkoxy group, preferably one having fewer than 6 carbon atoms, and the reductone of Formula II

II wherein $R_1$ and $R_2$ are the same or different, and may represent H, alkyl, cycloalkyl, aryl, or an alkyl group with a solubilizing group such as —OH, sulfonamide, sulfamoyl, or carbamoyl, $R_1$ and $R_2$ may be joined to complete a heterocyclic ring, $R_4$ and $R_5$ are H, OH, alkyl, aryl, cycloalkyl, or may together represent an alkylidene group, n is 1 or 2 and $R_3$ is H, alkyl, aryl, or $CO_2R_6$ where $R_6$ is alkyl, and wherein the logarithm of the partition coefficient for the reductone when equilibrated as a solute between n-octanol and water (logP) is less than 0.293.

19 Claims, No Drawings

LATENT IMAGE STABILITY USING ALKYNYLAMINES AND IODIDE EMULSIONS

CROSS-REFERENCE TO RELATED APPLICATIONS

This is a continuation-in-part of application Ser. No. 08/918,168 filed Aug. 25, 1997, now abandoned, entitled "LATENT IMAGE STABILITY USING ALKYNYLAMINES AND IODIDE EMULSIONS" by Jon N. Eikenberry et al.

FIELD OF THE INVENTION

This invention relates to the use of alkynylamines with a photographic emulsion to obtain optimum latent image stability in a given color film format.

BACKGROUND OF THE INVENTION

The ability to maintain a latent image is of paramount importance to commercial photographic products. Customers typically make exposures on a roll of film over a period of time which can range up to several months from the first to the last exposure. These latent images are then processed together and should produce dye densities in color film independent of exposure age for optimum color reproduction. Complete maintainence of the latent image under these conditions is rarely achieved in the complex chemical milleau consitituting a color film. Rather, ways have been sought to minimize its loss and thereby deliver to the customer the most consistent color reproduction possible.

A variety of latent image stabilizers have been described (Herz, U.S. Pat. No. 4,374,196) with notable success achieved by derivatives of N-2-alkynylaminobenzoxazolium salts (Lok et al, U.S. Pat. No. 4,451,557 and U.S. Pat. No. 4,378,426 and Eikenberry et al, U.S. Pat. No. 5,500,333). Although these materials showed good success in reducing latent image loss, they were examined in single color, single layer formats considerably simpler than the complex, tri-color, multi-layer format needed for complete and accurate color reproduction.

The translation of single layer latent image stability to multi-layer performance is often frustrated by unexpected offsets and chemical interactions. Furthermore, a multi-layer format will evolve during the development of a new commercial film for a variety of reasons: to gain improved color reproduction through inter-image effects; to improve the chemical stability prior to exposure; to reduce sensitivity to variable processing factors; or for a variety of other reasons. This evolution usually involves a shift in the chemical and/or physical make up of the multi-layer film that brings with it a change in the requirements needed to obtain latent image stability. For example, a combination of emulsion and addenda that gave good performance in a single layer or in the initial multi-layer format may prove insufficient as the format evolves.

PROBLEM TO BE SOLVED BY THE INVENTION

There is, thus, a need for a technique of applying adjustable latent image stability that can be customized to a particular format. There is a need for improvement in latent image stability, particularly in photographic elements utilizing reductones.

SUMMARY OF THE INVENTION

It is an object of the invention to provide photographic elements having improved latent image stability.

Another object of the invention is to provide a means of obtaining the optimum stabilization of the latent image for a given color multi-layer film format by adjusting the addenda used in the chemical sensitization.

These and other objects of the invention generally are accomplished by a photographic element wherein at least one layer comprises silver halide grains wherein said grains have a surface iodide of less than 0.6 mol percent, total grain iodide of about 1.0 to 10 mol percent, said iodide being introduced in the core of the grains, an alkynylamine compound having Formula I:

I

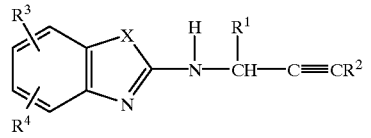

wherein X represents oxygen, sulfur, selenium, or an unsubstituted or alkyl substituted nitrogen; $R^1$ represents hydrogen or an alkyl of from 1 to 5 carbon atoms, and $R^2$ represents hydrogen, or an alkyl, aryl, heteroaryl, carbocyclic or heterocyclic group, and $R^3$ and $R^4$ independently represent hydrogen, halogen, or a substituted or unsubstituted alkyl or alkoxy group, preferably one having fewer than 6 carbon atoms, and the reductone of Formula II

II

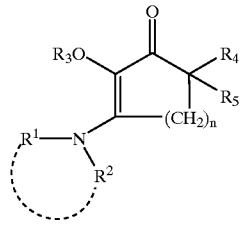

wherein $R_1$ and $R_2$ are the same or different, and may represent H, alkyl, cycloalkyl, aryl, or an alkyl group with a solubilizing group such as —OH, sulfonamide, sulfamoyl, or carbamoyl, $R_1$ and $R_2$ may be joined to complete a heterocyclic ring, $R_4$ and $R_5$ are H, OH, alkyl, aryl, cycloalkyl, or may together represent an alkylidene group, n is 1 or 2 and $R_3$ is H, alkyl, aryl, or $CO_2R_6$ where $R_6$ is alkyl, and wherein the logarithm of the partition coefficient for the reductone when equilibrated as a solute between n-octanol and water (logP) is less than 0.293.

In another embodiment of the invention there is shown a photographic element comprising at least one yellow dye forming blue sensitive layer, at least one cyan dye forming red sensitive layer, and at least one magenta dye forming green sensitive layer wherein at least one of said layers comprises silver halide grains wherein said grains have a surface iodide of less than 0.6 mol percent, a total grain iodide of about 1.0 to 10 mol percent, said iodide being introduced in the core of the grains, an alkynylamine compound of Formula I and the reductone of Formula II.

ADVANTAGEOUS EFFECT OF THE INVENTION

The invention has the advantage of allowing the originator of a new color film to adjust the latent image stabilization in a predictable manner as the film composition evolves. The convenient selection of the emulsion/addenda combination giving optimum latent image stabilization simplifies the work needed to insure that the customer will obtain the most consistent color reproduction of prints from a roll of film exposed over a period of time.

DETAILED DESCRIPTION OF THE INVENTION

The invention has numerous advantages over prior photographic elements in exhibiting both raw storage stability and latent image keeping ability. The photographic elements of the invention by the combination of additives may be adjusted to exhibit exceptional latent image stability while also being raw storage stable.

Any suitable alkynylamine compound may be utilized in the invention. Suitable is an alkynylamine compound of Formula I.

Specific compounds contemplated to be suitable as the alkynylamine compound of the invention include:

Compound IA:

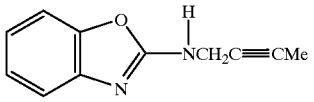

Compound IB:

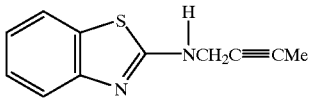

Compound IC:

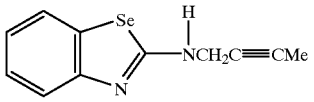

Compound ID:

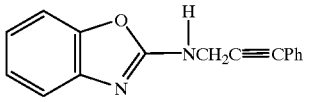

Compound IE:

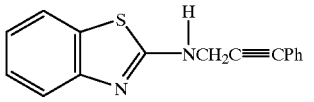

Compound IF:

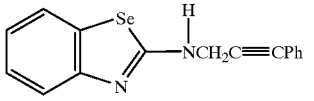

Compound IG:

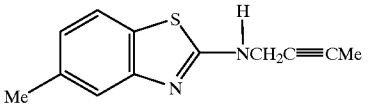

-continued

Compound IH:

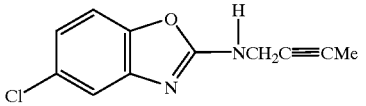

Compound II:

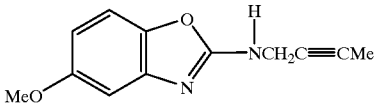

Compound IJ:

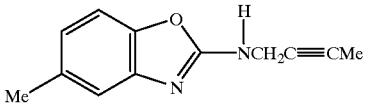

Compound IK:

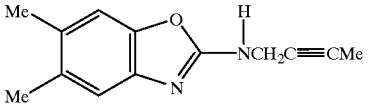

Compound IL:

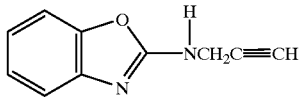

Compound IM:

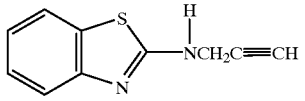

Compound IN:

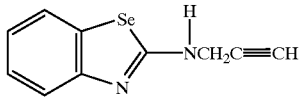

Compound IO:

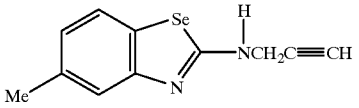

Compound IP:

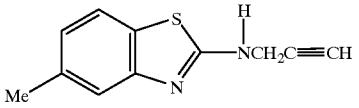

Compound IQ:

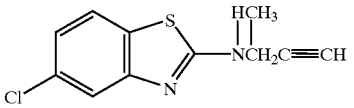

-continued

Compound IR:

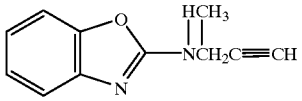

Compound IS:

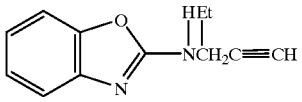

and

Compound IT:

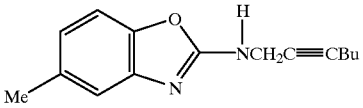

In the practice of the invention, it is also contemplated that the alkynylamine compound be water soluble; that is, that it further comprise a water solubilizing group. In this embodiment, the water solubilizing group can be substituted anywhere on the alkynylamine (e.g., as a substituent on $R^3$ or $R^4$). Preferably, it should be sufficient to enable the alkynylamine to be soluble at 0.1 grams per liter of water. Representative solubilizing groups include carboxy, carboxyalkyl, sulfo, sulfoalkyl, phosphate, phosphatoalkyl, phosphono, phosphonoalkyl, carbonamido, sulfonamido, hydroxy, and salts thereof. Preferably, the water solubilizing group is a carboxy or sulfo group, or salt thereof. Optimally, it is the sodium or potassium salt of a carboxy group.

The alkynylamine compounds utilized in the invention may be prepared by any methods known in the art. Examples of such methods can be found in U.S. Pat. Nos. 4,451,557; 4,378,426; and 5,413,905, all of which are incorporated herein by reference.

The photographic emulsions employed in this invention are generally prepared by precipitating silver halide crystals in an aqueous colloidal medium (matrix) by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Coating techniques known in the art include dip coating, air knife coating, curtain coating and extrusion coating.

For the purpose of improving the sensitivity of the emulsion, the alkynylamine compounds of the invention may be added to the silver halide emulsion at any time during the preparation of the emulsion. Preferably, they are added during the latter half of grain growth, during or before chemical sensitization or during final melting and co-mixing of the emulsion and additives for coating. It is most desired that the compounds be added prior to the heating step of chemical sensitization.

The alkynylamine compounds can be introduced to the emulsion at the appropriate time by any means commonly practiced in the art such as by dissolving in a convenient organic solvent, or by dispersing in a gelatin matrix. They may be added to the coupler melt which may be either dualed or combined with the emulsion melt during the coating process; to the vessel containing the aqueous gelatin salt solution before the start of the precipitation; or to a salt solution during precipitation. Other modes are also contemplated. Temperature, stirring, addition rates and other precipitation factors may be set within conventional ranges, by means known in the art, so as to obtain the desired physical characteristics.

The alkynylamine compounds can be incorporated into the emulsion in an amount between about 0.1 and about 200 milligrams per mole of silver halide. When the compounds are added during the precipitation of the emulsion's grains, they are preferably added in an amount between 1 and about 200 milligrams per mole of silver halide. When added during sensitization, it is more preferred to use a lesser amount, typically in the order of 0.1 to 100 milligrams per mole of silver halide. After sensitization, it is preferable to use an amount of the alkynylamine compound between about 1 and 200 milligrams per mole of silver halide.

The photographic element may also contain a transparent magnetic recording layer such as a layer containing magnetic particles on the underside of a transparent support, as in U.S. Pat. Nos. 4,279,945 and 4,302,523 and *Research Disclosure*, November 1993, Item 3490, which are incorporated herein by reference. Typically, the element will have a total thickness (excluding the support) of from about 5 to about 30 $\mu$m.

Any suitable reductone compound may be utilized in the invention. The reductones of the invention can be represented by Formula II. The invention finds its preferred use in improving the performance of color negative films.

The following examples illustrate the practice of this invention. They are not intended to be exhaustive of all possible variations of the invention. Parts and percentages are by weight unless otherwise indicated.

EXAMPLES

The innovation of photographic film often involves testing and formulation in several stages. A simple single layer format suffices for the first screening of emulsions, addenda, couplers, etc. As the program matures, the components are examined in a multi-layer format more closely resembling the final film. This multi-layer format can be a complete one involving all emulsions needed to produce a wide latitude of color reproduction, or it can be a simplified format in which only one emulsion is coated in a particular color record to allow evaluation free of interaction with other emulsions. All three formats: simple single layer, simple multi-layer, and a full multi-layer will be utilized herein.

In simple single layer formats where only one emulsion is coated, the measurement of latent image stability is usually done by referencing the photographic speed of an aged latent image against that of a fresh latent image on the same lot of film. Typically, a speed loss is observed as shown by Example 1 in Table 1.

TABLE 1

Effect of an Alkynylamine on Latent Image Stability in a Single Layer vs. a Multi-Layer Format

| Coating | Emulsion | Alkynyl amine | Amount (mg/mole) | Speed Change Single Layer* | Density Change Full Multi-layer** |
|---|---|---|---|---|---|
| Example 1 | A | none | — | −13 | |
| Example 1a | A | none | — | | −0.058 |
| Example 2 | A | IL | 2 | −8 | |
| Example 2a | A | IL | 2 | | −0.025 |
| Example 3 | B | none | — | −15 | |
| Example 3a | B | none | — | | −0.039 |
| Example 4 | B | IL | 2 | −17 | |
| Example 4a | B | IL | 2 | | −0.010 |

*Speeds were measured as 100(1 − logH) where H is the exposure in lux-sec necessary to produce a density 0.15 above Dmin. Speed changes in a single layer were measured by first exposing a sample and then holding the sample for 1 week at 120 F./50% RH before performing the usual C-41 process. The speed from this aged sample was then compared to the speed obtained from a control sample which was exposed and immediately processed with the aged sample.

**Density changes in the multi-layer were obtained by aging unexposed film for 3 weeks at 100 F./50% RH, exposing the film and then holding one more week at 100 F./50% RH before processing. The control in this case was a film strip held 4 weeks at 100 F./50% RH which was then exposed and immediately processed with the sample containing the aged latent image. Density was measured at step 11 in a 21 step tablet which corresponds to the region in the density vs. exposure curve dominated by the emulsion of interest.

In a full multi-layer format where several emulsions are coated in each color record to obtain a wide exposure latitude, it is often difficult or impossible to measure the exact photographic speed of only one emulsion. Therefore, emulsion performance under these circumstances is often done by comparing dye densities at a given exposure. For example, the single layer speed loss of −13 observed for Emulsion A in Example 1 in Table 1 translates to a density loss of −0.058 in Example 1a in a multi-layer environment.

When additive IL is added to Emulsion A after chemical sensitization as suggested by Lok et al in U.S. Pat. No. 4,451,557, the single layer latent image stability is improved as reflected by the smaller speed loss shown for Example 2 in Table 1. Likewise, the smaller density loss in Example 2a in the multi-layer format also indicates better latent image stability.

In the case of Examples 3 and 4 employing Emulsion B which is a smaller version of Emulsion A, the addition of IL did not appear to improve latent image stability in the single layer format as shown by the similar speed losses observed in the presence and absence of IL (Example 4 vs. 3 in Table 1). However, when coated in a multi-layer format, this comparison does show improved latent image stability as reflected by the smaller density loss for Example 4a vs 3a. This case illustrates the importance of evaluating latent image stability in the full film format to be used in the final product.

Although the addition of la enhanced latent image stability, density losses in the multi-layer are still observed in Examples 2a and 4a, and there remains a need for more improvement. We have made the unexpected observation that a modification of the iodide structure of the conventional run/dump emulsion (Wightman and Johnson, U.S. Pat. No. 5,164,292) utilized by Emulsions A and B can greatly influence the latent image stability. For example, Emulsion C in Table 2 is essentially the same as Emulsion B except that the iodide dump step in the preparation of Emulsion B has been omitted and the % iodide run into the kettle during the first part of the make has been increased to compensate for the iodide not added in the dump. A significant result of this procedure change is the reduction of surface iodide from nearly 5 to 0.2 mol %. Comparison of Examples 1a and 3a with Example 5a in Table 2 demonstrates that the effect of this reduction in surface iodide is to eliminate the loss in density, even producing a slight gain in the absence of an alkynylamine. With the addition of an alkynylamine, the multi-layer density change for an emulsion with low surface iodide becomes even more positive as seen in Example 6a. This behavior contrasts with the negative density changes seen with the high surface iodide emulsions in Examples 2a and 4a.

TABLE 2

Effect of Surface Iodide on Latent Image Stability

| Coating | Emulsion | Surface Iodide (%) | Alkynyl amine | Amount (mg/mole) | Density Change Full Multi-layer** |
|---|---|---|---|---|---|
| Example 1a | A | 4.8 | None | — | −0.058 |
| Example 3a | B | 4.6 | None | — | −0.039 |
| Example 5a | C | 0.2 | None | — | +0.006 |
| Example 2a | A | 4.8 | IL | 2 | −0.025 |
| Example 4a | B | 4.6 | IL | 2 | −0.010 |
| Example 6a | C | 0.2 | IA | 1 | +0.024 |

*See Table 1 for the definition of speed changes.

It should be noted that in both Emulsion B and Emulsion C, all iodide is introduced to the grain during the formation of the first 70% of the make or into the core of the grain. During the last 30% of the make, silver nitrate is added with only enough bromide to control the pBr at a preselected level. This portion of the make constitutes a silver over-run with no further iodide added. However, in the case of Emulsion B, a substantial amount of iodide in the form of silver iodide seeds is introduced just before this silver over-run. This silver iodide must metathesize onto the existing grains during the silver over-run and apparently is slow in doing so since the iodide is concentrated at the surface as reflected in the nearly 5 mole % iodide measured in this region. Emulsion C, in contrast, has no silver iodide dumped into the kettle and the silver over-run simply covers the iodide already added during the formation of the core of the grain with the consequence of only 0.2 mole % iodide being measured at the surface.

Although the the gain in density seen for Example 6a could be as detrimental to color reproduction as the loss in density observed in Example 2a, we find this behavior to be an advantage in certain film development programs. For example, additional addenda utilized to modify film performance other than latent image stability may, in fact, effect latent image stability by moving the density change to lower values. In such a case, the positive bias of Example 6a could be used to advantage. For example, the addition of piperidino hexose reductone (PHR) to the multi-layer format can improve the stability of the film prior to exposure as shown in U.S. Pat. No. 5,763,146. However, when PHR was utilized for this purpose, the latent image stability was degraded as shown in Table 3.

TABLE 3

Effect of PHR on Latent Image Stability in a Color Negative Film

| Coating | Emulsion | Alkynyl amine | Amount (mg/mol) | PHR Added | Density Change Full Multi-layer |
|---|---|---|---|---|---|
| Example 2a | A | IL | 2 | No | −0.025 |
| Example 2b | A | IL | 2 | Yes | −0.048 |
| Example 4a | B | IL | 2 | No | −0.010 |
| Example 4b | B | IL | 2 | Yes | −0.021 |
| Example 6a | C | IA | 1 | No | +0.024 |
| Example 6b | C (invention) | IA | 1 | Yes | −0.014 |

*See Table 1 for definition of density change.

In every example in Table 3 the density change observed in the absence of PHR becomes more negative with the addition of PHR. The positive density change for Example 6a then becomes a small negative bias in Example 6b (Invention) and provides a marked improvement in latent image stability over what is observed for the usual combination of emulsion and alkynylamine in Examples 2b or 4b.

The improved performance for the combination of a low surface iodide emulsion and alkynylamine in the presence of PHR is further illustrated in Table 4 where the emulsions were compared in pilot coatings for production. The combination in Example 8 which constitutes the invention is clearly producing better latent image stability than Example 7 which utilizes the conventional combination of emulsion and alkynylamine.

TABLE 4

Latent Image Stability of Emulsion/Alkynylamine Combinations in the Presence of PHR

| Coating | Emulsion | Alkynyl Amine | Amount (mg/mole) | Density Change Full Multi-layer* |
|---|---|---|---|---|
| Example 7 | B | IL | 2 | −0.056 |
| Example 8 | D (invention) | IA | 3 | −0.021 |

*See Table 1 for definition of density change.

The unexpected performance of the invention is clearly illustrated by examining the effect of adding different levels of IA to Emulsion D. Whereas adding increasing levels of an alkynylamine to Emulsion B never eliminates a density loss, addition of increasing levels to Emulsion D produces first a zero bias, then a positive bias as shown in Table 5. (In these examples and all those that follow, emulsions were coated singly as the only yellow emulsion in the blue record of a multi-layer film. The use of this simplified multi-layer format makes speed measurements possible and, thus, provides a more direct comparison of emulsion performance than in a full multi-layer.)

TABLE 5

Latent Image Stability of a High Surface Iodide Emulsion vs. a Low Surface Iodide Emulsion in the Presence of an Alkynylamine and PHR

| Coating | Emulsion | Surface Iodide (%) | Alkynyl amine | Amount (mg/mole) | Speed Change* Simple Multi-layer |
|---|---|---|---|---|---|
| Example 9 | B | 4.6 | IL | 1 | −9 |
| Example 10 | B | 4.6 | IL | 2 | −11 |

TABLE 5-continued

Latent Image Stability of a High Surface Iodide Emulsion vs. a Low Surface Iodide Emulsion in the Presence of an Alkynylamine and PHR

| Coating | Emulsion | Surface Iodide (%) | Alkynyl amine | Amount (mg/mole) | Speed Change* Simple Multi-layer |
|---|---|---|---|---|---|
| Example 11 | B | 4.6 | IL | 3 | −8 |
| Example 12 | B | 4.6 | IL | 4 | −7 |
| Example 13 | D (invention) | 0.2 | IA | 1 | −6 |
| Example 14 | D (invention) | 0.2 | IA | 2 | 0 |
| Example 15 | D (invention) | 0.2 | IA | 3 | 2 |
| Example 16 | D (invention) | 0.2 | IA | 4 | 5 |

*See Table 1 for the definition of speed changes.

The ability to vary the latent image stability by varying the amount of IA permits customization of the film to suit a particular multi-layer format. For instance, if more PHR were needed to improve raw stock stability (stability before exposure), one could add more IA to compensate for the accompanying deterioration in latent image stability.

Attempts to improve the performance of the conventional run/dump emulsion by adding either IL or IA to Emulsion B failed to significantly improve latent image stability as shown in Table 6. This data demonstrate that the elimination of the latent image speed loss is uniquely and unexpectedly observed only for the combination of an emulsion with a low surface iodide with an alkynylamine in the presence of PHR.

TABLE 6

Latent Image Stability of Different Emulsions with Alkynylamines in the Presence of PHR

| Coating | Emulsion | Alkynyl amine | Point of Addition* | Amount (mg/mole) | Speed Change** Simple Multi-layer |
|---|---|---|---|---|---|
| Example 10 | B | IL | after | 2 | −11 |
| Example 17 | B | IL | before | 2 | −7 |
| Example 18 | B | IA | after | 2 | −10 |
| Example 19 | B | IA | after | 4 | −11 |
| Example 20 | B | IA | before | 2 | −10 |
| Example 14 | D Invention | IA | before | 2 | 0 |

*Refers to whether the alkynylamine was added before or after chemical ripening.
**See Table 1 for the definition of speed changes.

Emulsion Preparation

Emulsion A

Emulsion A is a tabular grain, bromoiodide emulsion containing 4% iodide. It is in the class described as run/dump and was prepared according to the procedure described by Wightman and Johnson in U.S. Pat. No. 5,061,616. For the first 70% of the make, iodide was added uniformly at the rate of 1.5% of the silver halide being added. When 70% of the total silver had been added, silver iodide was dumped into the making kettle in the amount of 3% of the total silver halide that would be added. An outer shell of silver bromide was then applied to complete the make. The emulsion was prepared at a temperature of 750° C. and employed 5 mmol of ammonia/mole of total silver in a 10 min digest immediately following nucleation. The emulsion grains were 2.69×0.13 $\mu$m with 4.8% iodide at their surface.

Emulsion B

This emulsion was prepared in a manner similar to A except the making temperature was 54° C. and 32 mmol of ammonia/mole of total silver was used in the digest which lasted 2.5 min. The emulsion grains were 1.43×0.12 μm with 4.6% iodide at their surface.

Emulsion C

Emulsion C is a tabular grain, bromoiodide emulsion containing 2.8% iodide. It belongs to the class known as run iodide and was prepared in a manner similar to A except the silver iodide dump was eliminated, and the iodide added during the first 70% of the make was increased to 4% of the silver halide being added. The emulsion grains were 1.76×0.12 μm with 0.2% iodide at their surface.

Emulsion D

This emulsion was prepared identically to Emulsion C except the batch size was 10 fold that of Emulsion C to provide enough material for pilot coatings. The emulsion grains were 1.84×0.12 μm with 0.2% iodide at their surface.

EMULSION SENSITIZATION

The chemical sensitization of each emulsion was formulated to give the optimum speed/fog performance. Amounts shown are what would be added to 1 mole of emulsion.

Example 1

Emulsion A was treated with the following: 100 mg of sodium thiocyanate, 40 mg of finish modifier (S-1), 0.8 mmol of sensitizing dyes consisting of equimolor parts D-1 and D-2, 20 mg of a mercaptotetrazole antifoggant (S-2), 2.5 mg of sodium aurous dithiosulfate, and 1.25 mg of sodium thiosulfate. The mixture was chemically ripened at 65.5° C. for 5 minutes and then treated with 1250 mg of tetraazaindene (S-3). The emulsion was coated in a simple, single layer format.

S-1

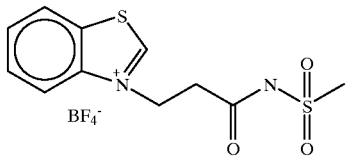

S-2

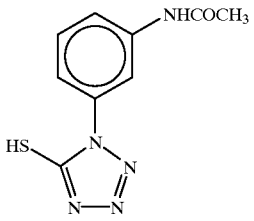

S-3

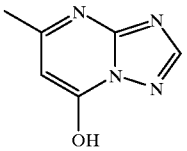

-continued

D-1

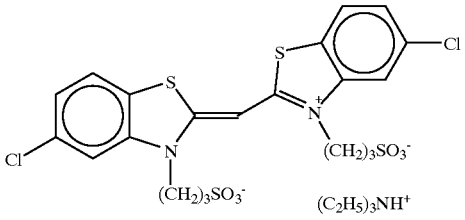

D-2

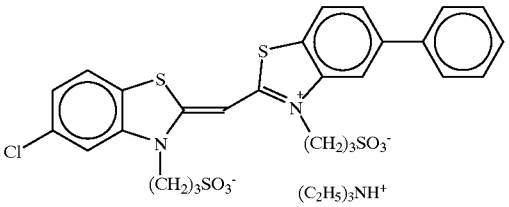

Organic Additives

Example 1a

Example 1a is identical to Example 1 except the emulsion was coated in a full multi-layer format.

Example 2

Emulsion A was treated as in Example 1 except that after chemical ripening, the emulsion was treated with 2 mg of IL, 0.96 mg gold sulfide, and 1250 mg of S-3. The emulsion was coated in a simple, single layer format.

Example 2a

Example 2a is identical to Example 2 except the emulsion was coated in a full multi-layer format.

Example 2b

Example 2b is identical to Example 2 except PHR has been added to the full multi-layer coating.

Example 3

Emulsion B was treated with the following: 60 mg of sodium thiocyanate, 35 mg of S-1, 0.8 mmol of sensitizing dyes consisting of equimolor parts D-1 and D-2, 15 mg of S-2, 2.5 mg of sodium aurous dithiosulfate, and 1.25 mg of sodium thiosulfate. The mixture was chemically ripened at 67° C. for 5 minutes, then treated with 2620 mg of S-3. The emulsion was coated in a simple, single layer format.

Example 3a

Example 3a is identical to Example 3 except the emulsion was coated in a full multi-layer format.

Example 4

Emulsion B was treated as in Example 2 except that after chemical ripening, the emulsion was treated with 2620 mg of tetraazaindene, 2 mg of IL, and 0.24 mg gold sulfide. The emulsion was coated in a simple, single layer format.

Example 4a

Example 4a is identical to Example 4 except the emulsion was coated in a full multi-layer format.

Example 4b

Example 4b is identical to Example 4a except PHR has been added to the full multi-layer coating.

Example 5a

Emulsion C was treated with the following: 100 mg of sodium thiocyanate, 1.1 mmol of sensitizing dyes consisting of equimolor parts D-1 and D-2, 4.5 mg of sodium aurous dithiosulfate, 2.25 mg of sodium thiosulfate, and 40 mg of S-1. The mixture was chemically ripened at 68° C. for 5 minutes and then treated with 1250 mg of S-3. The emulsion was coated in a full multi-layer format.

Example 6a

Emulsion C was treated as in Example 5a except 3 mg of IA was added immediately after D-2. The emulsion was coated in a full multi-layer format.

Example 6b

Example 6b is identical to Example 6a except PHR has been added to the full multi-layer coating.

Example 7

Example 7 is identical to Example 4b except the coating experiment was done on production scale.

Example 8

Example 8 is identical to Example 6b except Emulsion D was used in place of Emulsion C, and the coating experiment was done on production scale.

Examples 9–12

Examples 9–12 were done identically to Example 4b except the amount of IL increased progressively in the Examples 1 to 4 mg/mole as described in Table 5, and each emulsion was coated as the only emulsion in the blue record of a simple multi-layer format containing PHR.

Examples 13–16

Examples 13–16 were done identically to Example 6b except Emulsion D was used in place of Emulsion C, the amount of IA added increased progressively in the Examples from 1 to 4 mg/mole as described in Table 5, and each emulsion was coated as the only emulsion in the blue record of a simple multi-layer format containing PHR.

Examples 17–20

Examples 17–20 were done identically to Example 4b except the emulsion was treated with either IL or IA as described in Table 6, and it was coated as the only emulsion in the blue record of a simple multi-layer format containing PHR.

COATING EVALUATION

Single Layer

The emulsion was coated in a simple, single layer format over a pad of gelatin on a clear cellulose acetate support with a gelatin overcoat to protect the coating from abrasion. The emulsion layer contained an image forming coupler, Y-1, and an image modifying coupler, DIR-4, both producing a yellow dye.

Multi-layer

The emulsion was coated with couplers Y-1 and DIR-4 in the blue recording layer of a conventional color negative film consisting of red, green and blue sensitive layers coated over an antihalation layer on a clear cellulose acetate support. The multi-layer contained interlayers as needed to modify inter-image effects and had a UV absorbing layer coated last to eliminate UV absorption and protect against abrasion. The full multi-layer contained the emulsion of interest, as well as the other blue sensitive emulsions necessary to give a wide exposure latitude in the blue record. The simple multi-layer was identical to the full multi-layer except only the emulsion of interest was coated in the blue record.

The multi-layer color negative film elements were constructed using the following layer order:

Support
Layer 1 (AHU, Antihalation U-coat)
Layer 2 (Slow cyan imaging layer)
Layer 3 (Mid cyan imaging layer)
Layer 4 (Fast cyan imaging layer)
Layer 5 (Interlayer)
Layer 6 (Slow magenta imaging layer)
Layer 7 (Mid magenta imaging layer)
Layer 8 (Fast magenta imaging layer)
Layer 9 (Yellow filter layer)
Layer 10 (Slow yellow imaging layer)
Layer 11 (Fast yellow imaging layer)
Layer 12 (Ultraviolet protection layer)
Layer 13 (Protective overcoat)

The general composition of the multi-layer coatings follows. The examples cited herein specify changes made in layer 10. Layers 1–9 and layers 11 and 13 are common throughout for the described multi-layer coatings.

| Layer | Amount | Component |
|---|---|---|
| Layer 1 | 2045 mg/m$^2$ | Gelatin |
| | 134.5 | Gray Silver |
| | 30.1 | UV Absorber dye (DYE-1) |
| | 45.2 | UV Absorber (DYE-2) |
| | 21.5 | Magenta dye (DYE-3) |
| | 26.9 | Cyan dye (DYE-4) |
| | 0.032 | Yellow-colored magenta coupler (MC-1) |
| | 0.14 | Oxidized developer scavenger (OxDS-1) |
| Layer 2 | 1679 mg/m$^2$ | Gelatin |
| | 775 | Slow cyan silver |
| | 532.8 | Cyan dye former (C-1) |
| | 26.9 | Cyan image modifier (DIR-2) |
| | 56.5 | Cyan bleach accelerator (B-1) |
| | 32.3 | Magenta-colored cyan coupler (MC-2) |
| Layer 3 | 1076 mg/m$^2$ | Gelatin |
| | 430.5 | Mid cyan silver |
| | 180.8 | Cyan dye former (C-1) |
| | 19.4 | Cyan image modifier (DIR-2) |
| | 8.1 | Cyan bleach accelerator (B-1) |
| | 32.3 | Magenta-colored cyan coupler (MC-2) |
| Layer 4 | 914.9 mg/m$^2$ | Gelatin |
| | 592.0 | Fast cyan silver |
| | 209.9 | Cyan dye former (C-1) |
| | 26.9 | Cyan image modifier (DIR-2) |
| | 21.5 | Magenta-colored cyan coupler (MC-2) |
| Layer 5 | 538 | Gelatin |
| | 86.1 | Oxidized developer scavenger (OxDS-1) |
| Layer 6 | 1076 mg/m$^2$ | Gelatin |
| | 430.5 | Slow magenta silver |
| | 279.9 | Magenta dye former (M-1) |
| | 86.1 | Yellow-colored magenta coupler (MC-3) |
| | 10.7 | Yellow image modifier (DIR-3) |

-continued

| Layer | Amount | Component |
|---|---|---|
| Layer 7 | 699.7 | Gelatin |
| | 538.2 mg/m$^2$ | Mid magenta silver |
| | 96.9 | Magenta dye former(M-1) |
| | 118.4 | Yellow-colored magenta coupler (MC-3) |
| | 43.1 | Yellow image modifier (DIR-3) |
| Layer 8 | 699.7 mg/m$^2$ | Gelatin |
| | 538.2 | Fast magenta silver |
| | 70.0 | Magenta dye former(M-1) |
| | 53.8 | Yellow-colored magenta coupler (MC-3) |
| | 3.3 | Cyan bleach accelerator (B-1) |
| | 30.1 | Cyan image modifier (DIR-1) |
| Layer 9 | 645.8 mg/m$^2$ | Gelatin |
| | 86.1 | Oxidized developer scavenger (OxDS-1) |
| | 53.8 | YFD-1 |
| Layer 10 | 807 mg/m$^2$ | Gelatin |
| | 1873.0 | Slow yellow silver |
| | 893.0 | Yellow dye former (Y-1) |
| | 75.0 | Yellow image modifier (DIR-4) |
| | 32.0 | Cyan dye former (C-1) |
| | 32.0 | Cyan image modifier (DIR-2) |

-continued

| Layer | Amount | Component |
|---|---|---|
| | 22.0 | Cyan bleach accelerator (B-1) |
| Layer 11 | 807 mg/m$^2$ | Gelatin |
| | 517.0 | Fast yellow silver |
| | 237.0 | Yellow dye former (Y-1) |
| | 75.0 | Yellow image modifier (DIR-4) |
| | 5.0 | Cyan bleach accelerator (B-1) |
| Layer 12 | 699.7 mg/m$^2$ | Gelatin |
| | 107.6 | UV absorber dye (DYE-1) |
| | 215.3 | Lippmann silver |
| Layer 13 | 882.6 mg/m$^2$ | Gelatin |
| | 107.6 | Soluble matte beads |
| | Lubricants | |
| | 1.8% Hardener | |

The following structures were used in the multi-layer examples:

DYE-1

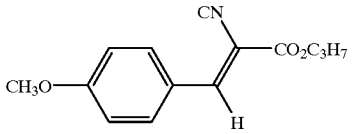

DYE-2

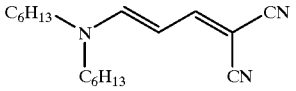

DYE-3

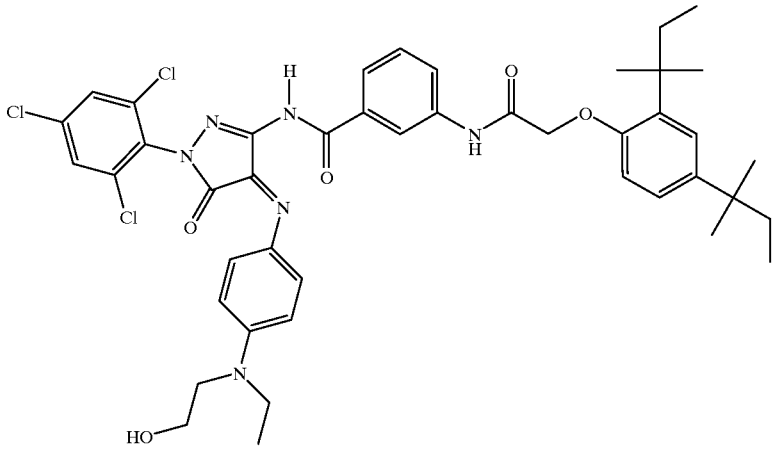

DYE-4

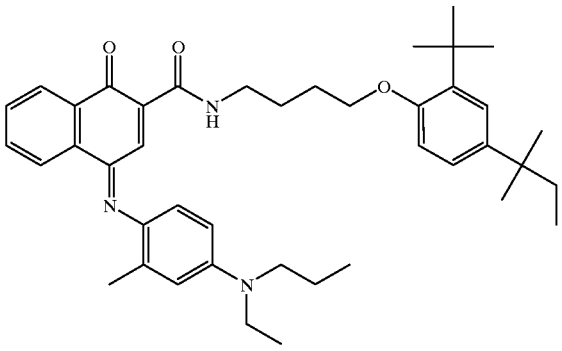

OxDS-1

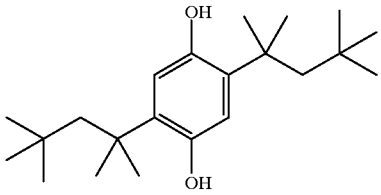

-continued
MC-1
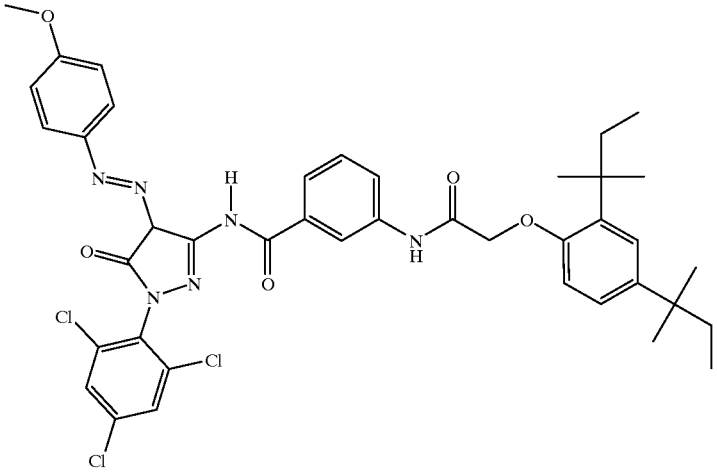
B-1
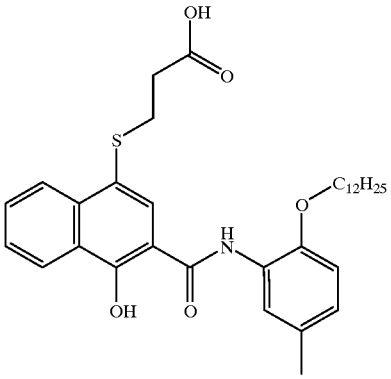
C-1
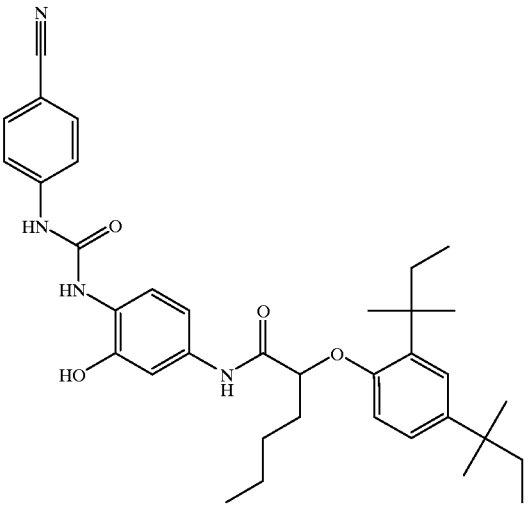
DIR-1
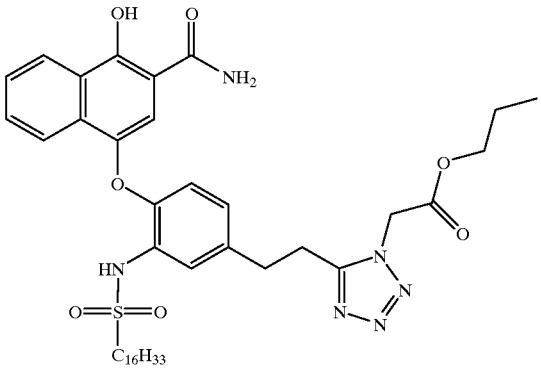
DIR-2
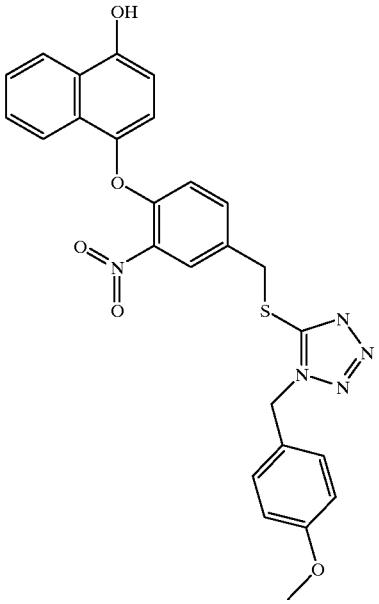

-continued
MC-2
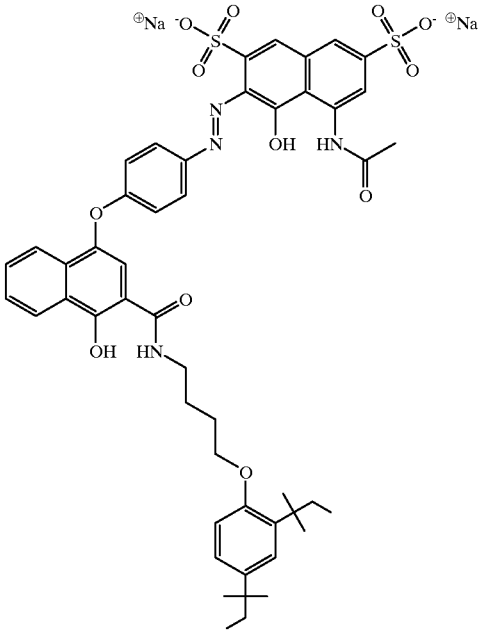
YFD-1
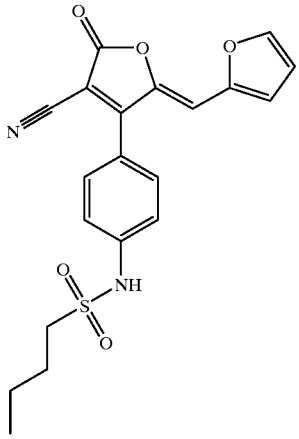
DIR-3
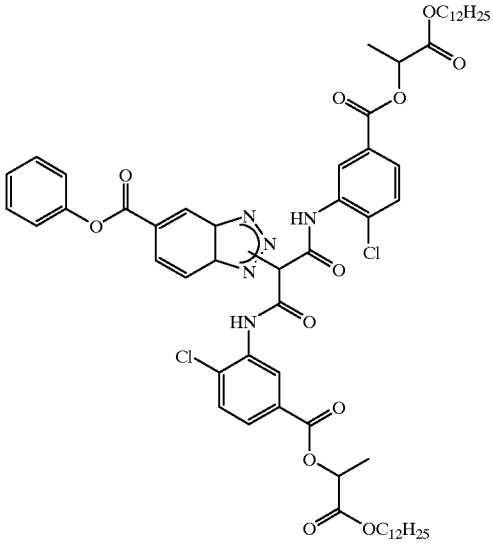

-continued
MC-3
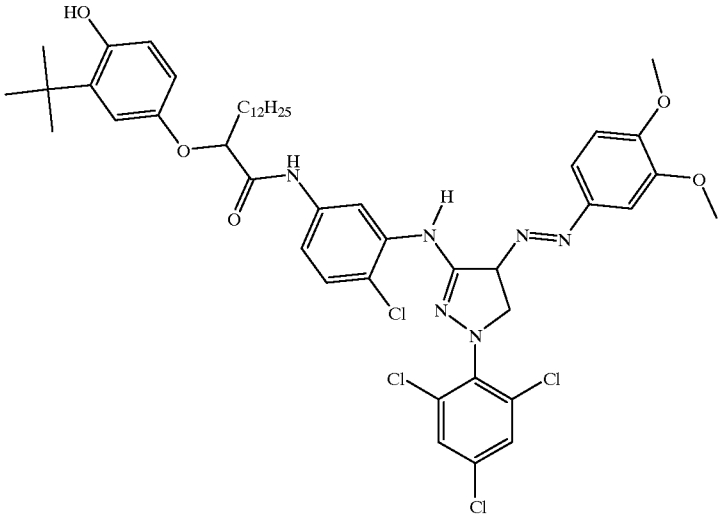
DIR-4
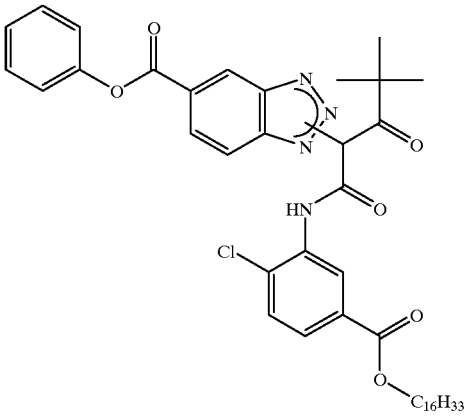
M-1
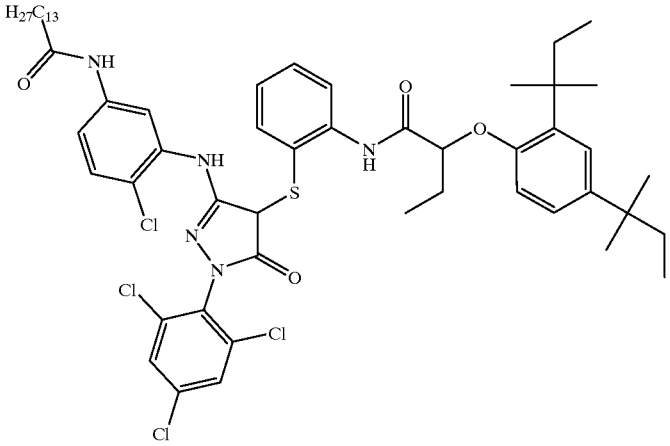

-continued

Y-1

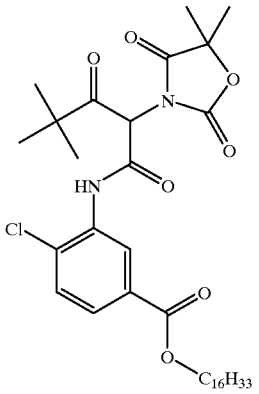

In those examples containing PHR, the compound was added as a water solution to the melts containing the couplers.

The invention has been described in detail with particular reference to certain preferred embodiments thereof, but it will be understood that variations and modifications can be effected within the spirit and scope of the invention.

What is claimed is:

1. A photographic element wherein at least one layer comprises silver halide grains wherein said grains have a surface iodide of less than 0.6 mol percent, total grain iodide of about 1.0 to 10 mol percent, an alkynylamine compound of Formula I:

I

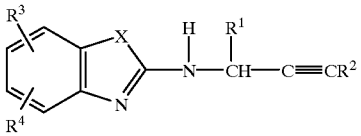

wherein X represents oxygen, $R^1$ represents hydrogen, and $R^2$ represents hydrogen, or an alkyl group, and $R^3$ and $R^4$ represent hydrogen, and the reductone of Formula II

II

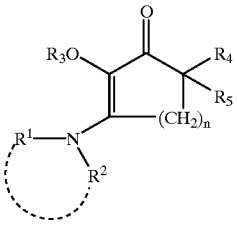

wherein $R_1$ and $R_2$ are the same or different, and represent H, alkyl, cycloalkyl, aryl, or an alkyl group with a solubilizing group of —OH, sulfonamide, sulfamoyl, or carbamoyl, $R_1$ and $R_2$ may be joined to complete a heterocyclic ring, $R_4$ and $R_5$ are H, OH, alkyl, aryl, cycloalkyl, or may together represent an alkylidene group, n is 1 or 2 and $R_3$ is H, alkyl, aryl, or $CO_2R_6$ where $R_6$ is alkyl, and wherein the logarithm of the partition coefficient for the reductone when equilibrated as a solute between n-octanol and water (logP) is less than 0.293.

2. The element of claim 1 wherein said silver halide grains comprise 1 to 5 mol percent total grain iodide.

3. The element of claim 1 wherein said silver halide grains have an iodide containing core forming about 70 percent by weight of the total silver halide in the grains.

4. The element of claim 1 wherein said alkynylamine compound comprises

Compound IA:

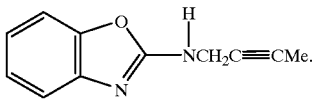

5. The element of claim 1 wherein in said reductone of Formula II $R_1$ and $R_2$ complete a morpholino ring.

6. The element of claim 1 wherein in said reductone of Formula II $R_3$ is hydrogen, $R_4$ is —OH, $R_5$ is methyl, and n is 1.

7. The element of claim 1 wherein said reductone of Formula II is selected from the group consisting of

R-2

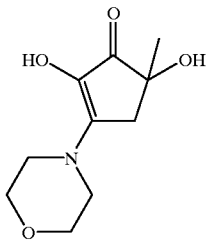

R-3

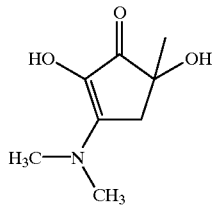

-continued
R-4
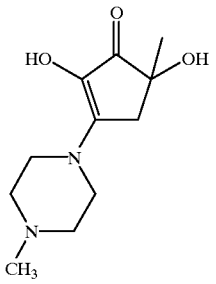
R-5
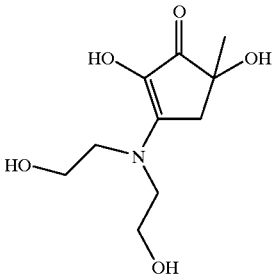
R-6
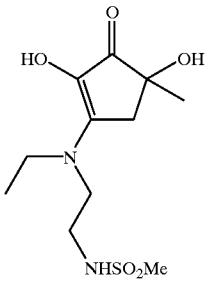
R-7
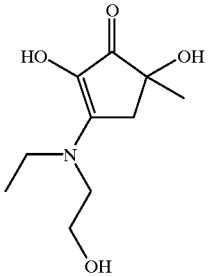
R-8
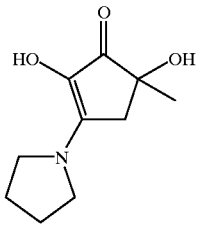
R-9
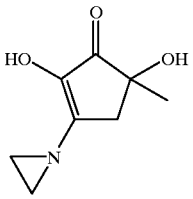
-continued
R-10
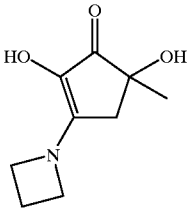
R-11
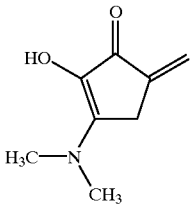
R-12
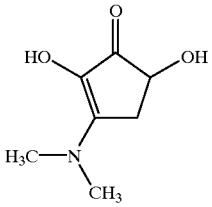
R-13
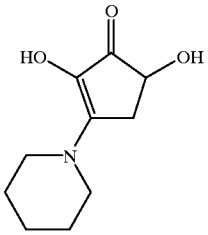
R-14
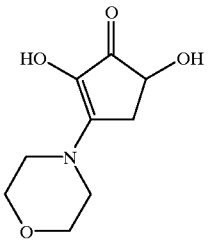
R-15
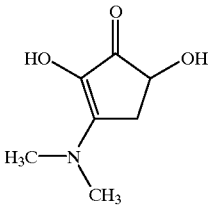

-continued

R-16

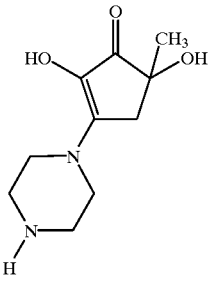

and

R-17

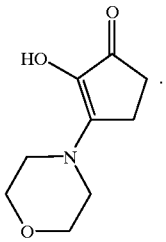

8. The element of claim 1 wherein said partition coefficient is between 0.293 and −1.0.

9. The element of claim 1 wherein said reductone is present in an amount between 0.5 and 50 mg/m$^2$.

10. A photographic element comprising at least one yellow dye forming blue sensitive layer, at least one cyan dye forming red sensitive layer, and at least one magenta dye forming green sensitive layer wherein at least one of said layers comprises silver halide grains wherein said grains have a surface iodide of less than 0.6 mol percent, total grain iodide of about 1.0 to 10 mol percent, an alkynylamine compound of Formula I:

I

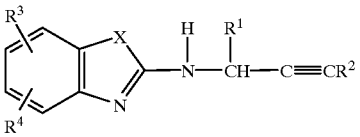

wherein X represents oxygen, $R^1$ represents hydrogen, and $R^2$ represents hydrogen, or an alkyl group, and $R^3$ and $R^4$ represent hydrogen, and the reductone of Formula II

II

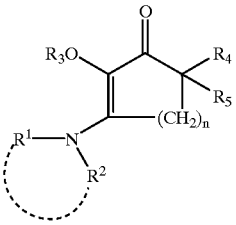

wherein $R_1$ and $R_2$ are the same or different, and represent H, alkyl, cycloalkyl, aryl, or an alkyl group with a solubilizing group of —OH, sulfonamide, sulfamoyl, or carbamoyl, $R_1$ and $R_2$ may be joined to complete a heterocyclic ring, $R_4$ and $R_5$ are H, OH, alkyl, aryl, cycloalkyl, or may together represent an alkylidene group, n is 1 or 2 and $R_3$ is H, alkyl, aryl, or $CO_2R6$ where $R_6$ is alkyl, and wherein the logarithm of the partition coefficient for the reductone when equilibrated as a solute between n-octanol and water (logP) is less than 0.293.

11. The element of claim 10 wherein said silver halide grains comprise 1 to 5 mol percent iodide.

12. The element of claim 10 wherein said silver halide grains have an iodide containing core forming about 70 percent by weight of the total silver halide in the grains.

13. The element of claim 10 wherein said alkynylamine compound comprises Compound IA:

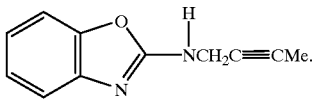

14. The element of claim 10 wherein in said reductone of Formula II $R_1$ and $R_2$ complete a morpholino ring.

15. The element of claim 10 wherein in said reductone of Formula II $R_3$ is hydrogen, $R_4$ is —OH, $R_5$ is methyl, and n is 1.

16. The element of claim 10 wherein said reductone of Formula II is selected from the group consisting of

R-2

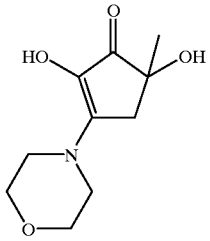

R-3

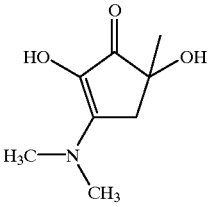

R-4

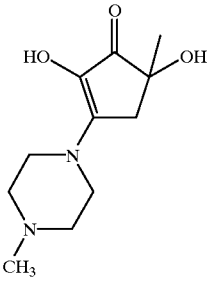

-continued
R-5
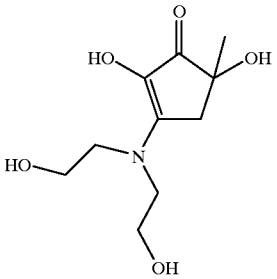
R-6
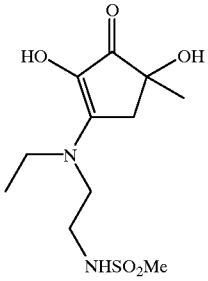
R-7
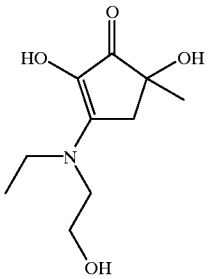
R-8
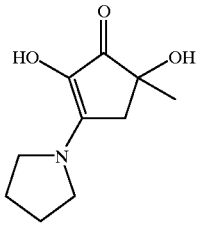
R-9
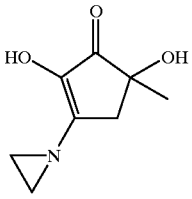
R-10
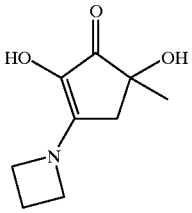
R-11
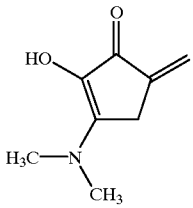
-continued
R-12
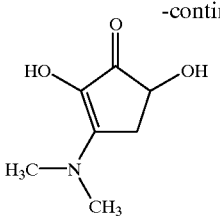
R-13
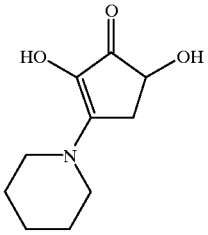
R-14
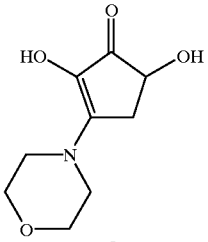
R-15
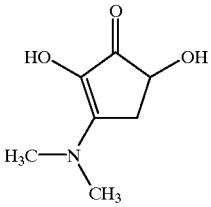
R-16
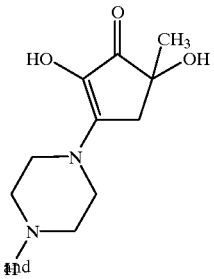
R-17
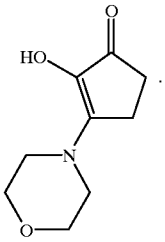
17. The element of claim 10 wherein said partition coefficient is between 0.293 and −1.0.
18. The element of claim 10 wherein said reductone is present in an amount between 1 and 20 mg/m$^2$.
19. The element of claim 10 wherein said at least one layer comprises the yellow dye forming layer.
* * * * *